US010897998B2

(12) United States Patent
Ou et al.

(10) Patent No.: US 10,897,998 B2
(45) Date of Patent: Jan. 26, 2021

(54) LUMBAR SUPPORT SEAT

(71) Applicant: ANJI SHENGXING OFFICE FURNITURE CO., LTD., Huzhou (CN)

(72) Inventors: Yaping Ou, Huzhou (CN); Qingsong Wu, Huzhou (CN)

(73) Assignee: Anji Shengxing Office Furniture Co., Ltd., Huzhou (CN)

( * ) Notice: Subject to any disclaimer, the term of this patent is extended or adjusted under 35 U.S.C. 154(b) by 0 days.

(21) Appl. No.: 15/895,002

(22) PCT Filed: Dec. 20, 2017

(86) PCT No.: PCT/CN2017/117472
§ 371 (c)(1),
(2) Date: May 17, 2019

(87) PCT Pub. No.: WO2018/133616
PCT Pub. Date: Jul. 26, 2018

(65) Prior Publication Data

US 2020/0138197 A1 May 7, 2020

(30) Foreign Application Priority Data

Jan. 19, 2017 (CN) ..... 2017 2 0095339 U

(51) Int. Cl.

| | |
|---|---|
| ***A47C 7/46*** | (2006.01) |
| ***A47C 7/44*** | (2006.01) |
| ***A47C 7/40*** | (2006.01) |
| ***A47C 7/72*** | (2006.01) |
| ***A47C 7/74*** | (2006.01) |

(52) U.S. Cl.
CPC ..... *A47C 7/446* (2013.01); *A47C 7/405* (2013.01); *A47C 7/467* (2013.01); *A47C 7/72* (2013.01); *A47C 7/74* (2013.01)

(58) Field of Classification Search
CPC ..... A47C 7/446; A47C 7/405; A47C 7/46; A47C 7/467; A47C 7/72; A47C 7/74
See application file for complete search history.

(56) References Cited

U.S. PATENT DOCUMENTS

| | | | | |
|---|---|---|---|---|
| 6,334,650 | B1 * | 1/2002 | Chien-Chuan | B60N 2/663 297/284.1 |
| 6,336,907 | B1 * | 1/2002 | Dono | A47C 7/467 601/148 |
| 6,739,664 | B2 * | 5/2004 | Kinoshita | A47C 1/03255 297/300.3 |

(Continued)

*Primary Examiner* — Philip F Gabler
(74) *Attorney, Agent, or Firm* — NK Patent Law

(57) ABSTRACT

The disclosure relates to the field of seat design and manufacture, in particular to a lumbar support seat. The disclosure is achieved by the following technical solution: a lumbar support seat, comprising a lumbar support and a gas spring; the lumbar support closely fits with the back of human body through the expansion of the gas spring when the back is moved, to provide continuous and uniform uplift force. An object of the disclosure is to overcome defects of the prior art and provide a lumbar support seat. When the user moves on the seat back and forth, the lumbar support may move synchronously in contact with the back of the human body, to fit with the waist in real time, thereby increasing the supporting force in waist position of the human body.

19 Claims, 15 Drawing Sheets

(56) References Cited

U.S. PATENT DOCUMENTS

| | | | | |
|---|---|---|---|---|
| 7,267,405 | B2 * | 9/2007 | Tin | A47C 1/03255<br>297/300.1 |
| 7,401,858 | B2 * | 7/2008 | Lee | A47C 7/40<br>297/316 |
| 7,625,046 | B2 * | 12/2009 | Sanchez | A47C 7/402<br>297/217.2 |
| 8,616,641 | B2 * | 12/2013 | Powicki | A47C 1/023<br>297/301.6 |
| 2007/0035164 | A1 * | 2/2007 | North | A47C 3/18<br>297/217.1 |

* cited by examiner

LUMBAR SUPPORT SEAT

CROSS REFERENCE TO RELATED APPLICATION(S)

This application is a 371 National Phase application of International Application No. PCT/CN2017/117472 filed on Dec. 20, 2017, which claims priority to Chinese Patent Application No. 201720095339.3 filed on Jan. 19, 2017, the contents of which are all incorporated by reference herein.

TECHNICAL FIELD

The disclosure relates to the field of seat design and manufacture, in particular to a lumbar support seat.

BACKGROUND OF THE DISCLOSURE

Seat is a kind of furniture widely used in daily life and work. The seat usually includes a base, a backrest, a supporting structure, armrests and other parts. To meet the individual needs of the people and bring more comfortable and healthy experience, the structure and function of the seat are being improved constantly. When users use the seat, they often rely on the base and backrest to support their hips and back, but the waist support is relatively weak, muscles and vertebra at the back of the human body will bear the pressure from upper body weight of the human body; if things continue this way, lumbar muscle strain and vertebral lesions may occur, thus bringing inconvenience to people's learning, living and working.

In recent years, to provide supporting force for the waist, the seat with a lumbar support is appearing on the market. A lumbar support is connected to the base or backrest, to provide excellent supporting force for the user's waist, so that the user can sit upright, with a good protection of lumbar vertebra. However, the existing lumbar support seat has a defect that the lumbar support does not closely fit with the human body. That is, when the user's sitting posture is adjusted, for example, leaning forward, the lumbar support cannot be adjusted telescopically along with the movement of the human body, and unable to effectively fit with the human body to support the waist. Therefore, the use effect of the lumbar support is not ideal.

Technical Problem

An object of the disclosure is to overcome defects of the prior art and provide a lumbar support seat. When the user moves on the seat forward and backward, the lumbar support may move synchronously in contact with the back of the human body, to fit with the waist in real time, thereby increasing the supporting force in waist position of the human body.

Technical Solution

The above technical object of the disclosure is realized by means of the following technical solution:

A lumbar support seat includes a lumbar support and a gas spring; the lumbar support closely fits with the back of human body through the expansion of the gas spring when the back is moved, to provide continuous and uniform uplift force.

In the technical solution, the most important component is the lumbar support that can be moved. When the sitting posture of human body changes, for example, when the human body leans forward, the lumbar support may also move forward, approach and closely fit with the back of the human body, thereby increasing the supporting force of the human body. The forward and backward power of the lumbar support comes from the telescopic operation of the gas spring. In the technical solution, the power component does not use other driving methods but defines the gas spring, the reason lies in that the driving force of the gas spring is continuous and uniform, so that the lumbar support may provide a uniform and continuous driving or supporting force for the human body, thus achieving more comfortable feeling. Other driving components or elastic components, such as elastic column and spring, are subject to Hooke's law. The supporting force provided by the component is positively correlated with its own deformation, so a continuous and uniform force cannot be provided during movement. In the technical solution, the structure, shape and connection relation of the seat cushion, armrest and chair leg are not specifically limited.

As a preferred embodiment of the disclosure, the lumbar support seat includes a rotating shaft assembly and a transmission part; the rotating shaft assembly includes a spindle; the lumbar support rotates about the spindle; the rotation is realized by transmitting the expansion of the gas spring through the transmission part.

In the disclosure, the extending direction of the gas spring is defined as the forward-backward direction; the extending direction of the gas spring, that is, the direction close to the waist of the human body is the front; the retracting direction of the gas spring, that is, the direction away from the waist of the human body is the back.

The motion trajectory of the gas spring is a linear motion trajectory in the forward-backward direction; the motion trajectory of the lumbar support is an arc-shaped motion trajectory rotating about the spindle; the role of the transmission part is to connect the gas spring with the lumbar support, and change the linear motion trajectory of the gas spring into the arc-shaped rotational motion trajectory. In addition, the installation direction of the gas spring (that is, whether the tail or head is forward) is not specifically limited in the technical solution.

As a preferred embodiment of the disclosure, one end of the gas spring is connected with the transmission part; the transmission part is connected with the spindle; the spindle is connected with the lumbar support and drives the lumbar support to rotate.

As one embodiment, the transmission part is directly connected to the spindle, and correspondingly, the lumbar support is also directly connected to the spindle. In the embodiment, the spindle is rotated and directly drives the lumbar support to rotate.

As a preferred embodiment of the disclosure, one end of the gas spring is connected with the transmission part; the transmission part is connected with a rotating connector; the rotating connector is sleeved on the spindle; the rotating connector is connected with the lumbar support and drives the lumbar support to swing.

As another embodiment, the spindle is only defined as a guide and position, and is not involved in rotation. A rotating connector sleeved on the spindle is provided; the rotating connector is used as a transmission medium for connecting the lumbar support and the transmission part. The transmission part drives the rotating connector to rotate, so as to directly drive the lumbar support to swing; the spindle does not rotate.

As a preferred embodiment of the disclosure, the transmission part includes a connecting arm connected to one end of the gas spring, a connecting rack connected to the connecting arm, and an oscillating gear connected with the rotating shaft assembly and meshed with the connecting rack.

As a preferred embodiment of the disclosure, the gas spring is installed below the seat cushion; the connecting arm is slidably connected below the seat cushion; an elongated groove is arranged on the connecting arm; the extending direction of the elongated groove is parallel to the telescopic direction of the gas spring; the lumbar support seat further includes a pin connected with the seat cushion and movably embedded in the elongated groove.

The gas spring can be directly installed below the seat cushion or indirectly assembled below the seat cushion through such connecting parts as bottom plate. The installation mode is not limited in the technical solution. The transmission realized through the gear and rack is an embodiment of the transmission part. Specifically, the gas spring is extended to drive the connecting arm to move forward; the end of the connecting arm is connected to the connecting rack, to drive the connecting rack to move forward; the oscillating gear driven by the forward-moving connecting rack is naturally rotated to drive the lumbar support to swing.

As described above, the swing of the lumbar support can be realized by the oscillating gear through direct connection and indirect connection. In the technical solution of direct connection, the oscillating gear is directly connected to the spindle, the lumbar support is also directly connected to the spindle, and the spindle is involved in rotation. In the technical solution of indirect connection, there is a rotating connector. The oscillating gear and the lumbar support are connected to the rotating connector, and the spindle is not involved in rotation.

The slotted direction of the elongated groove is also the forward-backward direction; the pin can be directly connected to the seat cushion at a fixture such as bottom plate; the coordination between the pin and the elongated groove may increase the forward orientation and stability when the connecting arm is pushed by the gas spring.

When the gas spring is retracted backward, the principle of driving the lumbar support to swing is the same as the above, and no further details hereto will be given.

As a preferred embodiment of the disclosure, the transmission part includes a connecting piece connected with the gas spring, a roller connected to the connecting piece, a drawn wire located in a wheel groove of the roller, and a rotating arm connected with the rotating shaft assembly; the drawn wire is connected with the rotating arm.

As a preferred embodiment of the disclosure, the rotating arm is provided with a wiredrawing head bayonet; the drawn wire is connected with the wiredrawing head bayonet.

The coordination between the drawn wire and the roller is another specific embodiment of the transmission part. Specifically, the gas spring moves forward and pushes the connecting piece to move forward; a roller is connected to the connecting piece; the drawn wire is installed on the roller, to form a forward-stretching motion of the drawn wire; the drawn wire pulls the rotating arm to rotate.

As described above, the connecting rotation of the lumbar support can be realized by the rotating arm through direct connection and indirect connection, and no further details hereto will be given.

As a preferred embodiment of the disclosure, the transmission part includes a connecting arm connected with the gas spring, a rotating arm connected with the rotating shaft assembly and a connecting rod; both ends of the connecting rod are hinged with the connecting arm and the rotary arm, respectively.

As a preferred embodiment of the disclosure, the gas spring is installed below the seat cushion; the connecting arm is slidably connected below the seat cushion; an elongated groove is arranged on the connecting arm; the extending direction of the elongated groove is parallel to the telescopic direction of the gas spring; the lumbar support seat further includes a pin connected with the seat cushion and movably embedded in the elongated groove.

The method of using the rotating arm and the connecting rod is another specific embodiment of the transmission part. Specifically, the gas spring is extended to drive the connecting arm to move forward; the connecting arm is hinged with a connecting rod; the other end of the connecting rod is hinged with a rotating arm. When the connecting arm moves forward, the rotating arm is driven to rotate by the connecting rod; the rotating arm rotates about the spindle.

As described above, the connecting rotation of the lumbar support can be realized by the rotating arm through direct connection and indirect connection, and no further details hereto will be given.

As a preferred embodiment of the disclosure, the transmission part includes a connecting arm connected with the gas spring, a gear connected to the connecting arm, a sprocket connector connected with the rotating shaft assembly and a chain; the chain is in meshing connection with the gear; the chain is in meshing connection with the sprocket connector.

The method of using the gear and chain is another specific embodiment of the transmission part. Specifically, a connecting arm is connected to the gas spring; a gear is connected to the connecting arm; the chain is in meshing connection with the gear. When the gas spring is extended, the chain is pulled forward; the other end of the chain is meshed with the sprocket connector, to drive the sprocket connector to swing around the spindle. In this manner, the technical solution that the chain is matched with the gear can also be replaced by a common cooperation scheme of the synchronous belt and synchronous pulley, and the principle is the same.

As a preferred embodiment of the disclosure, the transmission part includes a connecting arm I connected with the gas spring, an oscillating pin arranged on the connecting arm I, and a sleeve member sleeved on the spindle; the sleeve member is provided with an oscillating groove within which the oscillating pin slides.

As a preferred embodiment of the disclosure, a connecting plate is also provided; the spindle is connected with the seat cushion by the connecting plate.

The coordination between the oscillating pin and the oscillating groove is another specific embodiment of the transmission part. In the technical solution, the gas spring is extended to drive the connecting arm I to move forward; the oscillating pin is connected to the connecting arm I; the oscillating pin is driven to move forward; the motion trajectory of the oscillating pin is same as that of the gas spring; the both move forward horizontally in a straight line. The sleeve member is sleeved on the spindle, and the sleeve member may rotate about the spindle under the forward action of the oscillating pin.

To enhance the positioning stability of the spindle, the connecting plate may be used to connect the spindle with the seat cushion. As mentioned above, in the present application, the seat cushion is a superordinate concept, which can refer to the body of seat cushion or a seat plate, or an assembly comprising a cushion and a seat plate under the cushion. It should not be understood that the cushion defines a soft cushion.

As a preferred embodiment of the disclosure, the lumbar support includes a swing arm, a supporting plate movably connected with the swing arm, and an angle adjustment unit for adjusting the preset angle of the supporting plate.

As a preferred embodiment of the disclosure, the angle adjustment unit is a torsion spring.

The swing arm can be directly connected or indirectly connected with the transmission part; the swing arm is involved in swinging; a supporting plate is connected to the swing arm; the supporting plate is movably connected with the swing arm, that is, the supporting plate may adjust the angle relative to the swing arm, so that the supporting plate may flexibly and comfortably fit with the back of the human body.

A torsion spring is arranged at the junction of the supporting plate and the swing arm. The torsion spring has two functions: First, when the human body leans forward or backward, the torsion spring may provide a suitable torsion for the supporting plate, so that the angle adjustment of the supporting plate is more flexible; secondly, when the human body leaves the seat, the torsion spring may automatically adjust the angle of the supporting plate to a preset angle (for example, facing the front and non-tilting), so as to improve appearance and uniformity.

As a preferred embodiment of the disclosure, a functional block is arranged on the lumbar support.

As a preferred embodiment of the disclosure, the functional block is a magnetic block, an electric heating block or a massage block.

As a preferred embodiment of the disclosure, the functional block is detachably installed on the lumbar support.

Since the emphasis of the technical solution is that the lumbar support may closely fit with the back of the human body, in addition to the supporting comfortability, the technical solution also includes the fitting degree of the healthy magnetic therapy. Manufacturers can add different functional blocks according to actual business needs, such as magnetic therapy, electric heating and massage, and can also produce multiple functional blocks by using a unified connection installation method, so that users can choose to replace and install the blocks.

As a preferred embodiment of the disclosure, the lumbar support seat further includes a changeover switch assembly for switching the adjustment state and locking state of the gas spring.

The change-over switch assembly is used for switching the state of the gas spring. When the gas spring is in the adjustment state, the gas rod of the gas spring can be freely extended and retracted. In this state, when the human body leans backward, the gas rod is retracted and lumbar support swings backward; when the human body leans forward, the gas rod is extended and lumbar support swings forward. When the gas spring is in the locking state, the extension length of the gas rod is locked, and the lumbar support is also fixed and does not swing back and forth.

As a preferred embodiment of the disclosure, the gas spring is provided with a valve; the change-over switch assembly includes an operating member, a cable connected with the operating member, and a pull rod connected with the cable; the pull rod is connected against the valve and is pulled away from the valve by the cable.

As a preferred embodiment of the disclosure, the operating member includes a ratchet holder with ratchet; the ratchet holder is provided with a rotating shaft which is movably connected with a ratchet handle; the ratchet handle is provided with a pawl pin which is movably connected with a pawl; the pawl is corresponding to the ratchet; the front end of the ratchet handle is hooked with the tail end of the cable.

As a preferred embodiment of the disclosure, the pawl handle of the pawl passes through the through hole of the ratchet handle.

As a preferred embodiment of the disclosure, there are two rotating shaft assemblies which are located on both sides of the seat cushion; there are two lumbar supports which are individually connected to the rotating shaft assemblies, respectively.

As a preferred embodiment of the disclosure, there is one rotating shaft assembly which is located on one side of the seat cushion; there is one lumbar support which is connected to the rotating shaft assembly.

As a preferred embodiment of the disclosure, the lumbar support seat includes a chair leg assembly, a seat cushion, an armrest assembly and a backrest. A rocker arm is arranged on upper part of the casing of the armrest assembly; a pivot pin movably connected with the rear part of the backrest is arranged on the front end of the rocker arm; a bottom plate is fixed to the lower part of the seat cushion; the lower part of the bottom plate is fixedly connected to the upper part of the chair leg assembly; a control rack fixed at rear part in the bottom plate is connected with the front part of a gas spring; a connecting pin connected to one end of the connecting arm I is arranged at tail of the gas spring; an oscillating pin movably embedded in the oscillating groove at the lower part of the casing is arranged on another end of the connecting arm I.

As a preferred embodiment of the disclosure, the backrest is a separated two-piece structure.

As a preferred embodiment of the disclosure, the backrest is a monoblock structure.

As a preferred embodiment of the disclosure, the inner cavity of the casing is provided with a spacer; the inner cavity of the spacer is provided with a spindle; a connecting plate fixedly connected to the bottom plate is arranged on the lower part of the spindle; an armrest is installed on the upper part of the spindle.

As a preferred embodiment of the disclosure, a pin is arranged in the bottom plate; an elongated groove is arranged at the position corresponding to the pin in the connecting arm I; the pin is movably embedded in the elongated groove.

As a preferred embodiment of the disclosure, a ratchet holder with ratchet is arranged on one side of the bottom plate; the ratchet holder is provided with a rotating shaft which is movably connected with a ratchet handle; the ratchet handle is provided with a pawl pin which is movably connected with a pawl; the pawl is corresponding to the ratchet; the front end of the ratchet handle is hooked with the tail end of the cable.

As a preferred embodiment of the disclosure, the pawl handle of the pawl passes through the through hole of the ratchet handle.

As a preferred embodiment of the disclosure, the lower part of the pull rod movably installed on the control rack is hooked with the front end of the cable; the upper middle part of the pull rod corresponds to the valve of the gas spring.

As a preferred embodiment of the disclosure, the lumbar support seat includes a seat cushion, an armrest assembly and a backrest. A rocker arm is arranged on the upper part of the casing of the armrest assembly; the rocker arm is connected with the backrest; a bottom plate is arranged on the lower part of the seat cushion; a control rack connected with the gas spring is connected to the bottom plate; the gas spring is connected with the connecting arm I; an oscillating pin movably embedded in the oscillating groove at the lower part of the casing is arranged on the connecting arm I.

As a preferred embodiment of the disclosure, the backrest is a separated two-piece structure.

As a preferred embodiment of the disclosure, the backrest is a monoblock structure.

As a preferred embodiment of the disclosure, the inner cavity of the casing is provided with a spacer; the inner cavity of the spacer is provided with a spindle; a connecting plate fixedly connected to the bottom plate is arranged on the lower part of the spindle; an armrest is installed on the upper part of the spindle.

As a preferred embodiment of the disclosure, a pin is arranged in the bottom plate; an elongated groove is arranged at the position corresponding to the pin in the connecting arm I; the pin is movably embedded in the elongated groove.

As a preferred embodiment of the disclosure, a ratchet holder with ratchet is arranged on one side of the bottom plate; the ratchet holder is provided with a rotating shaft which is movably connected with a ratchet handle; the ratchet handle is provided with a pawl pin which is movably connected with a pawl; the pawl is corresponding to the ratchet; the front end of the ratchet handle is hooked with the tail end of the cable.

As a preferred embodiment of the disclosure, the pawl handle of the pawl passes through the through hole of the ratchet handle.

As a preferred embodiment of the disclosure, the lower part of the pull rod movably installed on the control rack is hooked with the front end of the cable; the upper middle part of the pull rod corresponds to the valve of the gas spring.

Beneficial Effects

In summary, the disclosure has the following beneficial effects:

1. The lumbar support can rotate, to adapt to the sitting posture of the human body and timely support the waist.
2. A gas spring is used as the power component; the gas spring may continuously provide a uniform and durable force for the lumbar support, so that the supporting force provided for the human body by the lumbar support is uniform and durable, thereby improving the comfortability.
3. The lumbar support can use an overall design and separated design on both sides.
4. The supporting plate is connected with the swing arm through a torsion spring, so the lumbar support better fits with the back; after people leave the lumbar support, the supporting plate may maintain a directly facing position without tilting, so as to improve appearance.
5. A functional component can be arranged on the lumbar support in a custom installation mode, to achieve magnetic therapy, massage, electric heating and other functions.
6. The extension length of the gas rod may be locked.

PREFERRED EMBODIMENT OF THE PRESENT DISCLOSURE

Embodiment 1

Figure 1:
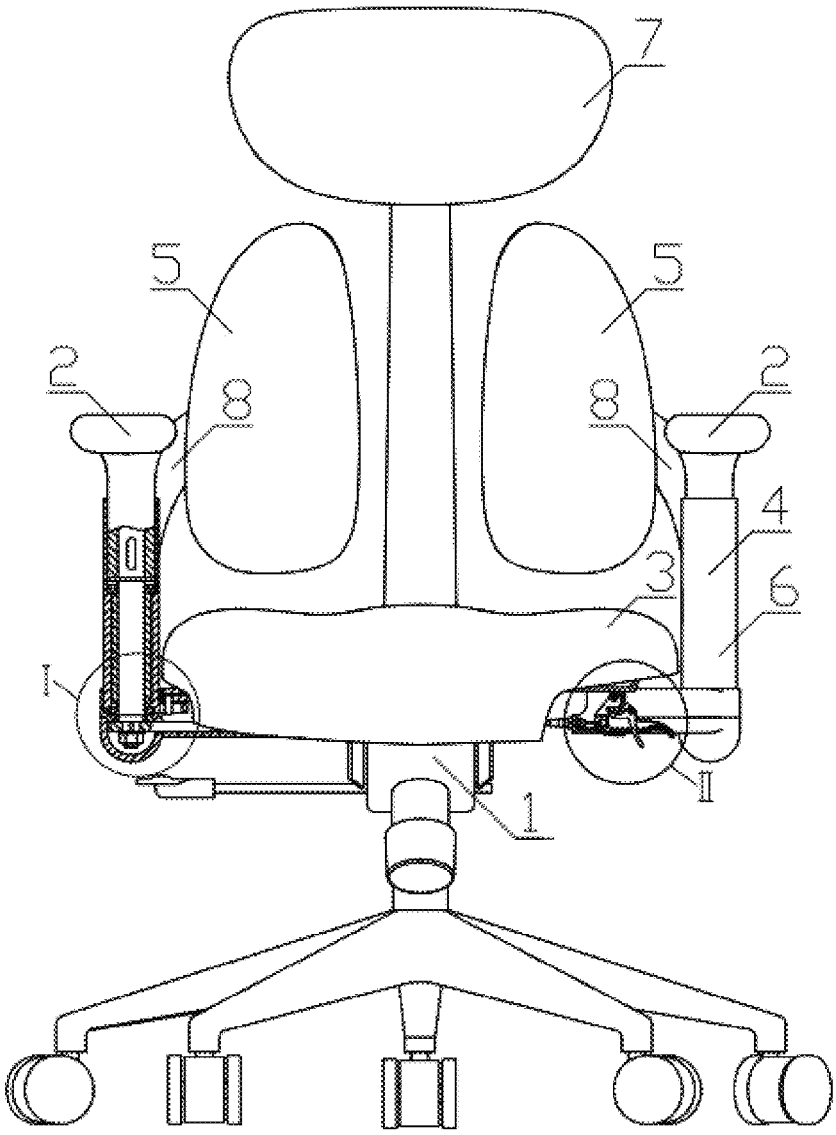
FIG. 1 is a front view of Embodiment I.
Figure 2:
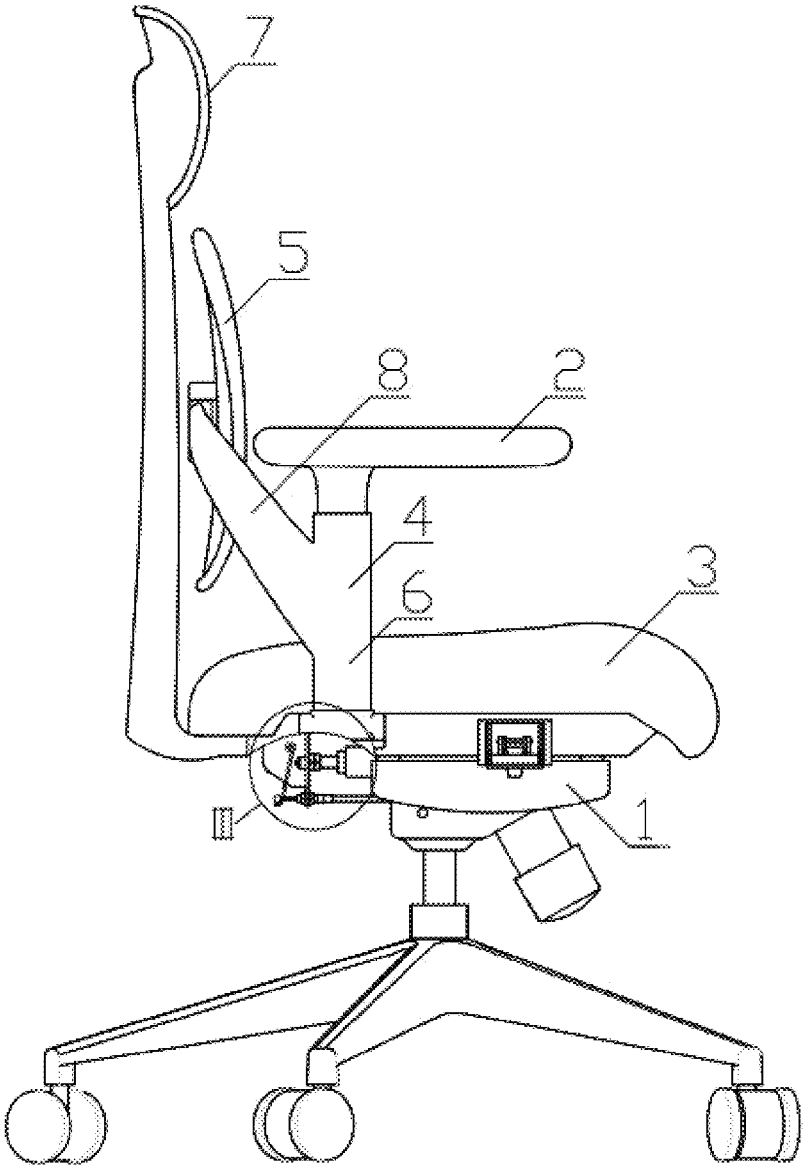
FIG. 2 is a left view of FIG. 1.
Figure 3:
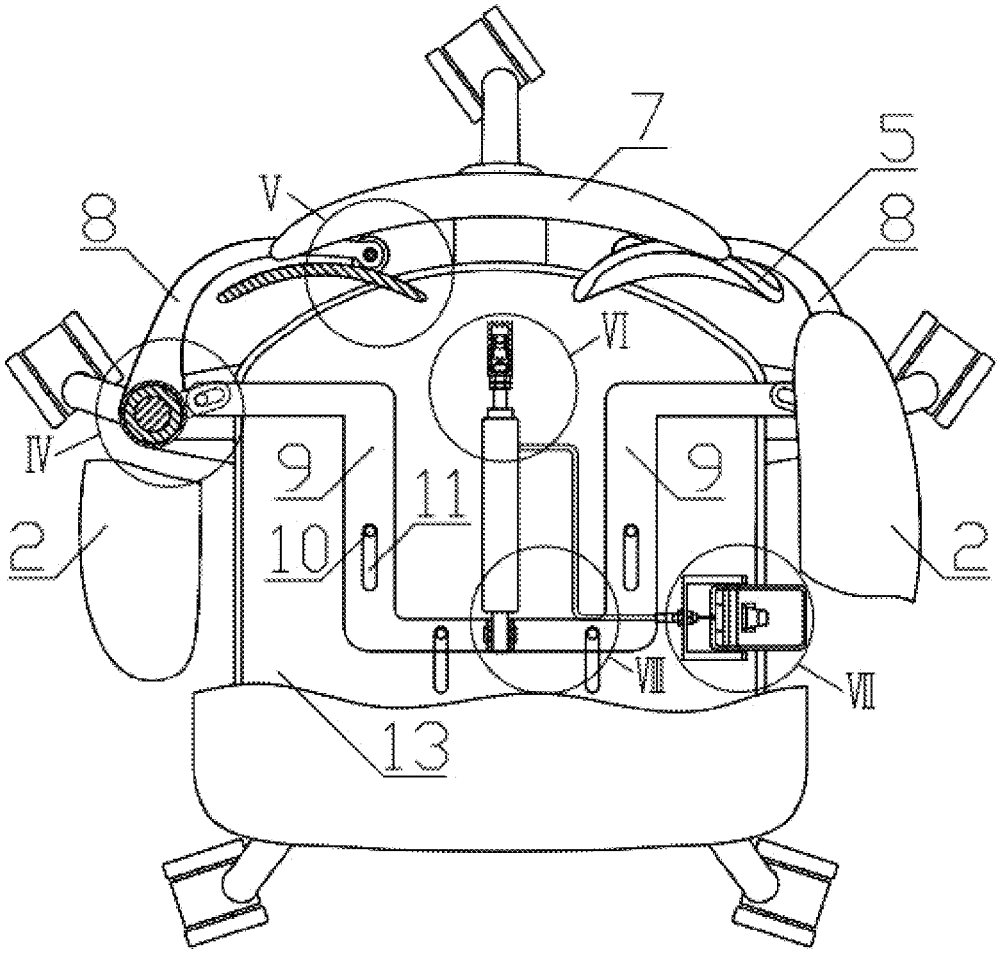
FIG. 3 is a top view of FIG. 1.
Figure 4:
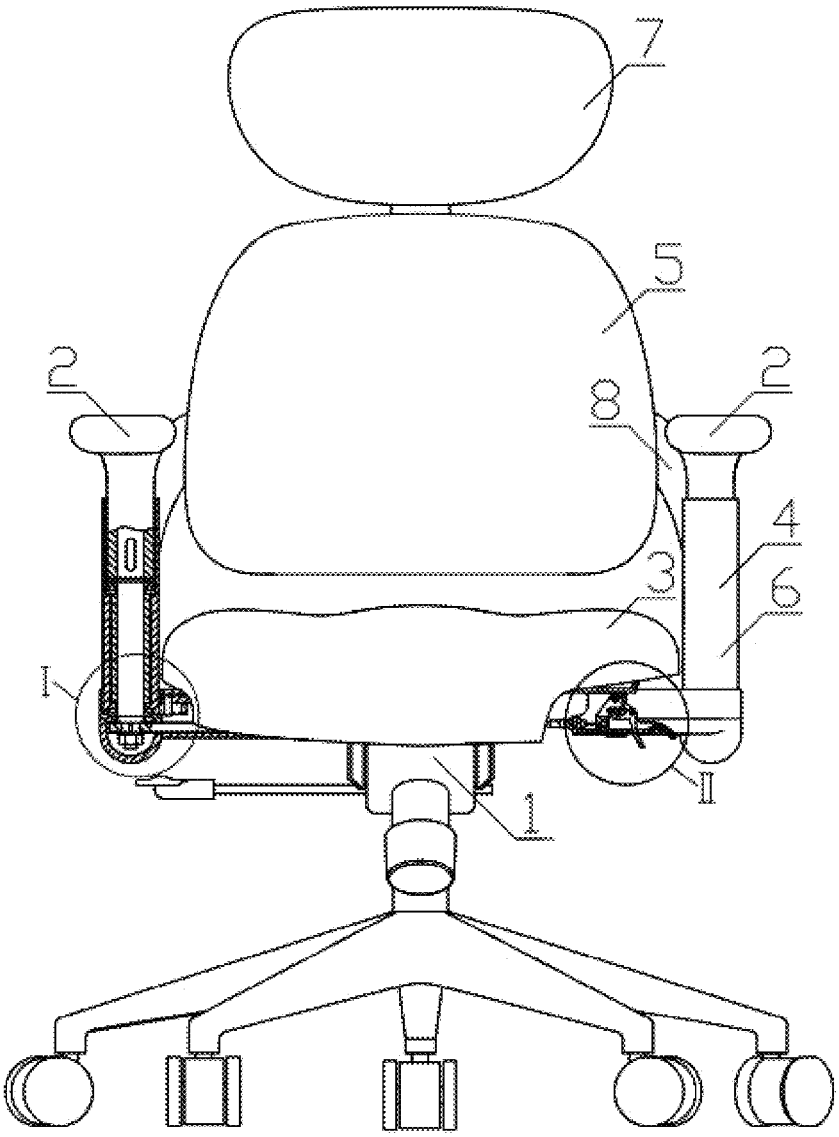
FIG. 4 is a front view of Embodiment II.
Figure 5:
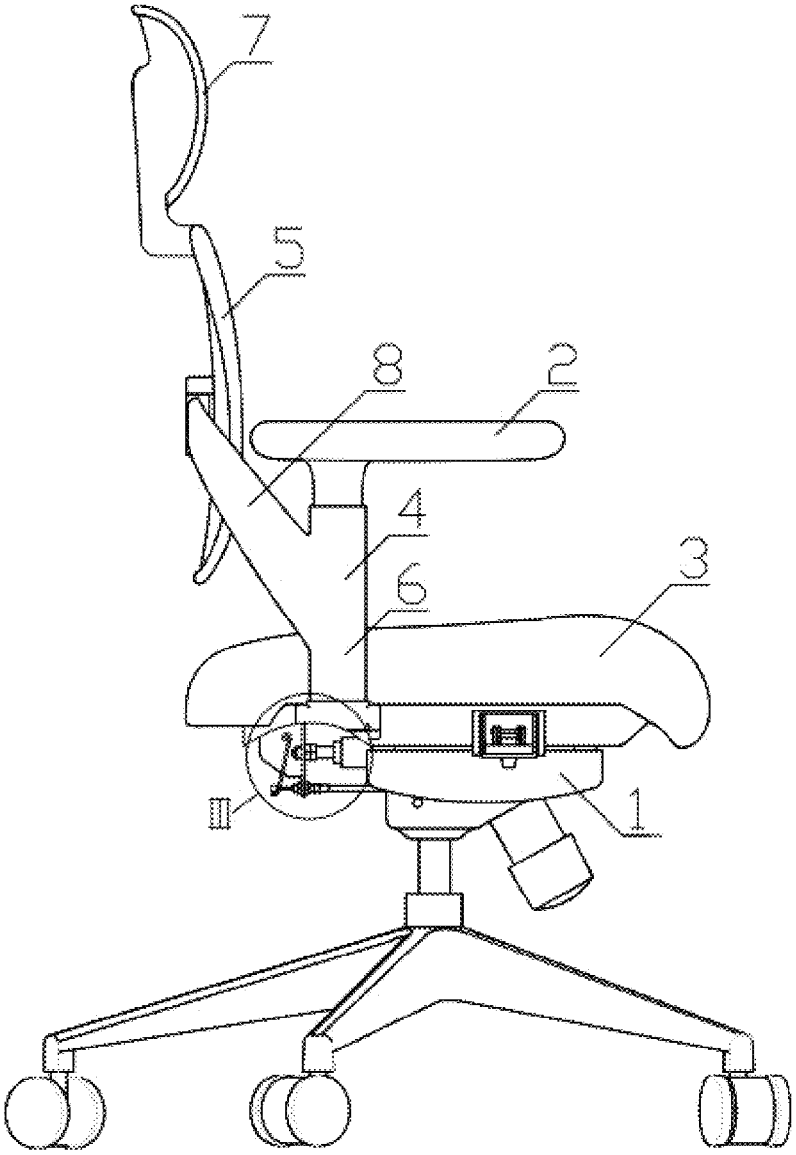
FIG. 5 is a left view of FIG. 4.
Figure 6:
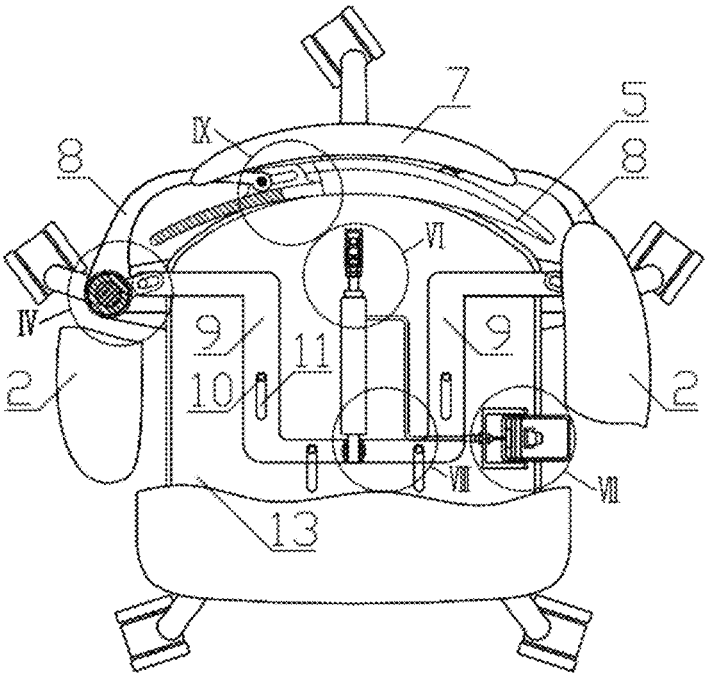
FIG. 6 is a top view of FIG. 4.
Figure 7:
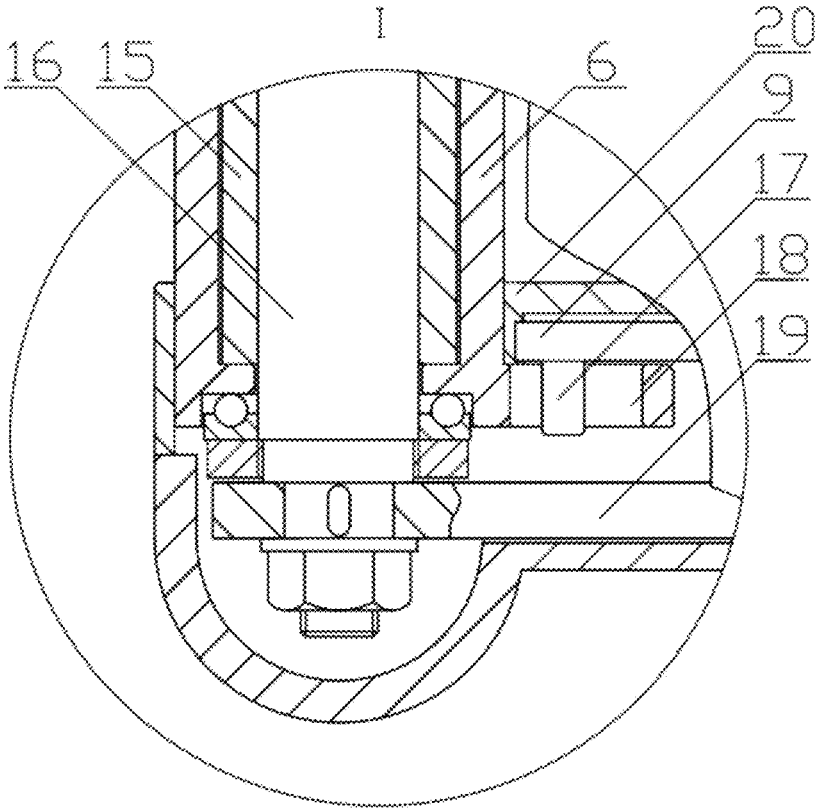
FIG. 7 is an enlarged view of area I in FIG. 1 and FIG. 4.

As shown in FIG. 1, FIG. 2, FIG. 3, FIG. 7, FIG. 8, FIG. 9, FIG. 10, FIG. 11, FIG. 12, FIG. 13 and FIG. 14, a chair with a backrest that may closely fit with the back of the human body to move, comprising a chair leg assembly 1, a seat cushion 3, an armrest assembly 4 and a backrest 5. A rocker arm 8 is arranged on upper part of the casing 6 of the armrest assembly 4; a pivot pin 32 movably connected with the rear part of the backrest 5 is arranged on the front end of the rocker arm 8; a bottom plate 13 is fixed to the lower part of the seat cushion 3; the lower part of the bottom plate 13 is fixedly connected to the upper part of the chair leg assembly 1; a control rack 31 fixed at rear part in the bottom plate 13 is connected with the front part of a gas rod 12; a connecting pin 33 connected to one end of the connecting arm I 9 is arranged at tail of the gas rod 12; an oscillating pin 17 movably embedded in the oscillating groove 18 at the lower part of the casing 6 is arranged on another end of the connecting arm I 9.

The backrest 5 is a separated two-piece structure.

The lower part of the headrest 7 is connected to the lower part of the seat cushion 3.

In the embodiment, the specific form of the sleeve member is a casing 6; the inner cavity of the casing 6 is provided with a spacer 15; the inner cavity of the spacer 15 is provided with a spindle 16; a connecting plate 19 fixedly connected to the bottom plate 13 is arranged on the lower part of the spindle 16; an armrest 2 is installed on the upper part of the spindle 16.

A pin 10 is arranged in the bottom plate 13; an elongated groove 11 is arranged at the position corresponding to the pin 10 in the connecting arm I 9; the pin 10 is movably embedded in the elongated groove 11.

A ratchet holder 23 with ratchet 24 is arranged on one side of the bottom plate 13; the ratchet holder 23 is provided with a rotating shaft 22 which is movably connected with a ratchet handle 26; the ratchet handle 26 is provided with a pawl pin 35 which is movably connected with a pawl 25; the pawl 25 is corresponding to the ratchet 24; the front end of the ratchet handle 26 is hooked with the tail end of the cable 21.

The pawl handle 27 of the pawl 25 passes through the through hole 28 of the ratchet handle 26.

The lower part of the pull rod 30 movably installed on the control rack 31 is hooked with the front end of the cable 21; the upper middle part of the pull rod 30 corresponds to the valve 29 of the gas rod 12.

The exposed portion of the connecting arm I 9 and connecting plat 19 is wrapped by a shield 20.

Embodiment of the Present Disclosure

Embodiment 2

As shown in FIG. 4, FIG. 5, FIG. 6, FIG. 7, FIG. 8, FIG. 9, FIG. 10, FIG. 12, FIG. 13, FIG. 14 and FIG. 15, a chair includes a chair leg assembly 1, a seat cushion 3, an armrest assembly 4 and a backrest 5. A rocker arm 8 is arranged on upper part of the casing 6 of the armrest assembly 4; a pivot pin 32 movably connected with the rear part of the backrest 5 is arranged on the front end of the rocker arm 8; a bottom plate 13 is fixed to the lower part of the seat cushion 3; the lower part of the bottom plate 13 is fixedly connected to the upper part of the chair leg assembly 1; a control rack 31 fixed at rear part in the bottom plate 13 is connected with the front part of a gas rod 12; a connecting pin 33 connected to one end of the connecting arm I 9 is arranged at tail of the gas rod 12; an oscillating pin 17 movably embedded in the oscillating groove 18 at the lower part of the casing 6 is arranged on another end of the connecting arm I 9.

The backrest 5 is a monoblock structure.

The pivot pin 32 is embedded in and movably connected with the backrest elongated groove 34 at rear part of the backrest 5.

The lower part of the headrest 7 is connected to the backrest 5.

The inner cavity of the casing 6 is provided with a spacer 15; the inner cavity of the spacer 15 is provided with a spindle 16; a connecting plate 19 fixedly connected to the bottom plate 13 is arranged on the lower part of the spindle 16; an armrest 2 is installed on the upper part of the spindle 16.

A pin 10 is arranged in the bottom plate 13; an elongated groove 11 is arranged at the position corresponding to the pin 10 in the connecting arm I 9; the pin 10 is movably embedded in the elongated groove 11.

A ratchet holder 23 with ratchet 24 is arranged on one side of the bottom plate 13; the ratchet holder 23 is provided with a rotating shaft 22 which is movably connected with a ratchet handle 26; the ratchet handle 26 is provided with a pawl pin 35 which is movably connected with a pawl 25; the pawl 25 is corresponding to the ratchet 24; the front end of the ratchet handle 26 is hooked with the tail end of the cable 21.

The pawl handle 27 of the pawl 25 passes through the through hole 28 of the ratchet handle 26.

The lower part of the pull rod 30 movably installed on the control rack 31 is hooked with the front end of the cable 21; the upper middle part of the pull rod 30 corresponds to the valve 29 of the gas rod 12.

The exposed portion of the connecting arm I 9 and connecting plat 19 is wrapped by a shield 20.

Figure 8:
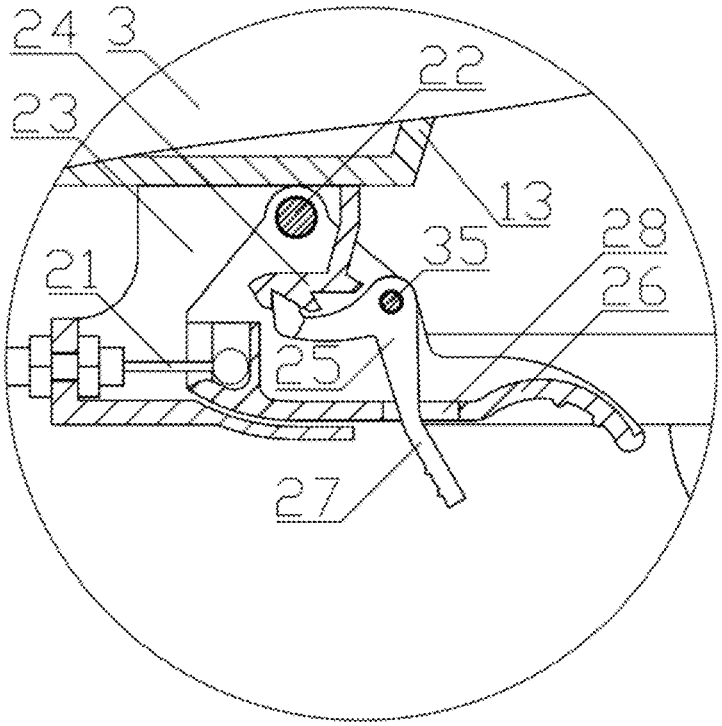
FIG. 8 is an enlarged view of area II in FIG. 1 and FIG. 4.
Figure 9:
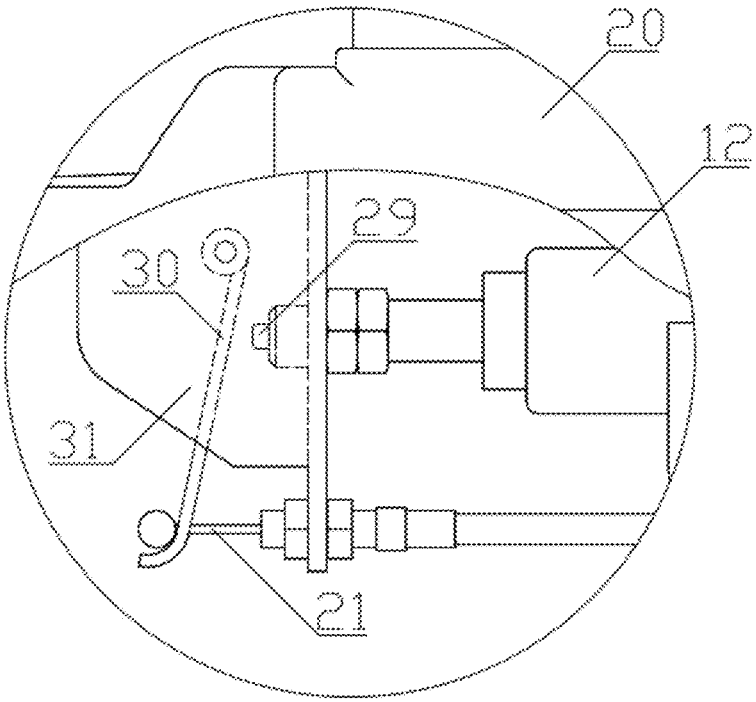
FIG. 9 is an enlarged view of area III in FIG. 2 and FIG. 5.
Figure 10:
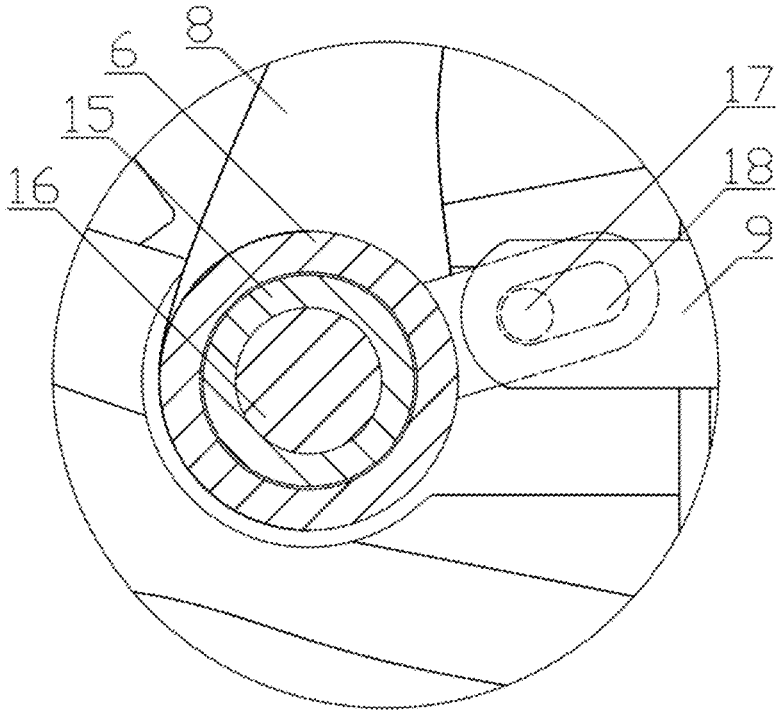
FIG. 10 is an enlarged view of area IV in FIG. 3 and FIG. 6.
Figure 11:
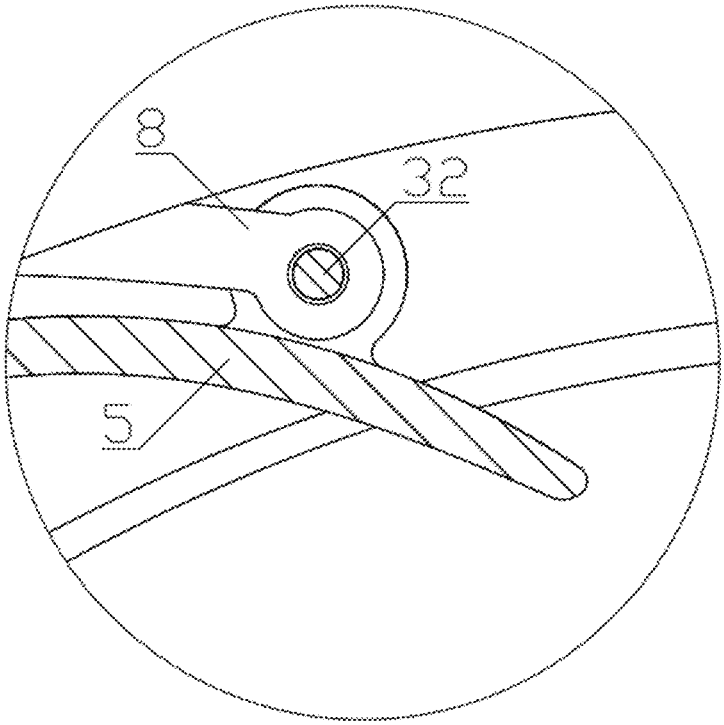
FIG. 11 is an enlarged view of area V in FIG. 3.
Figure 12:
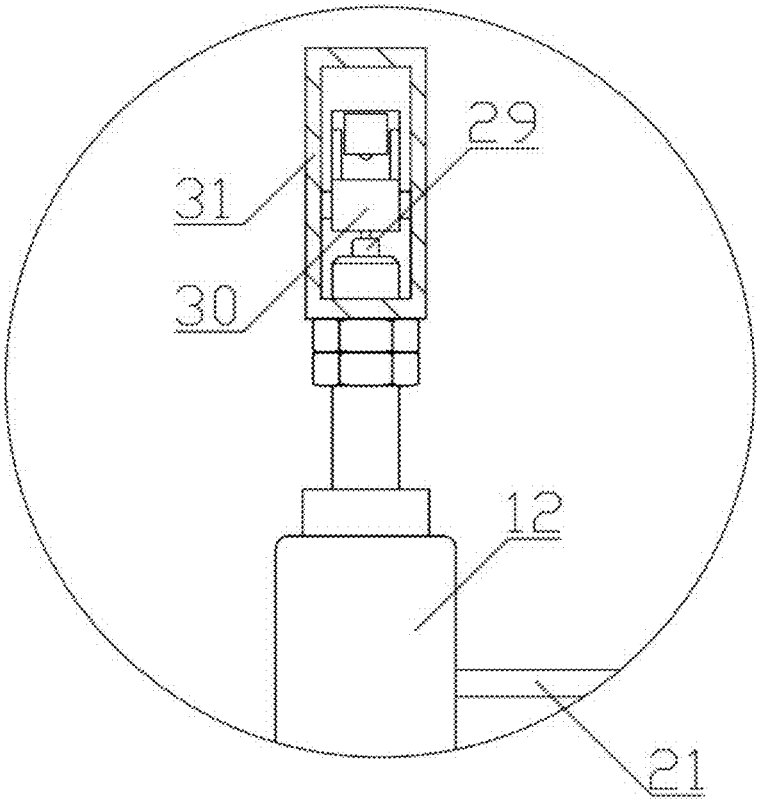
FIG. 12 is an enlarged view of area VI in FIG. 3 and FIG. 6.
Figure 13:
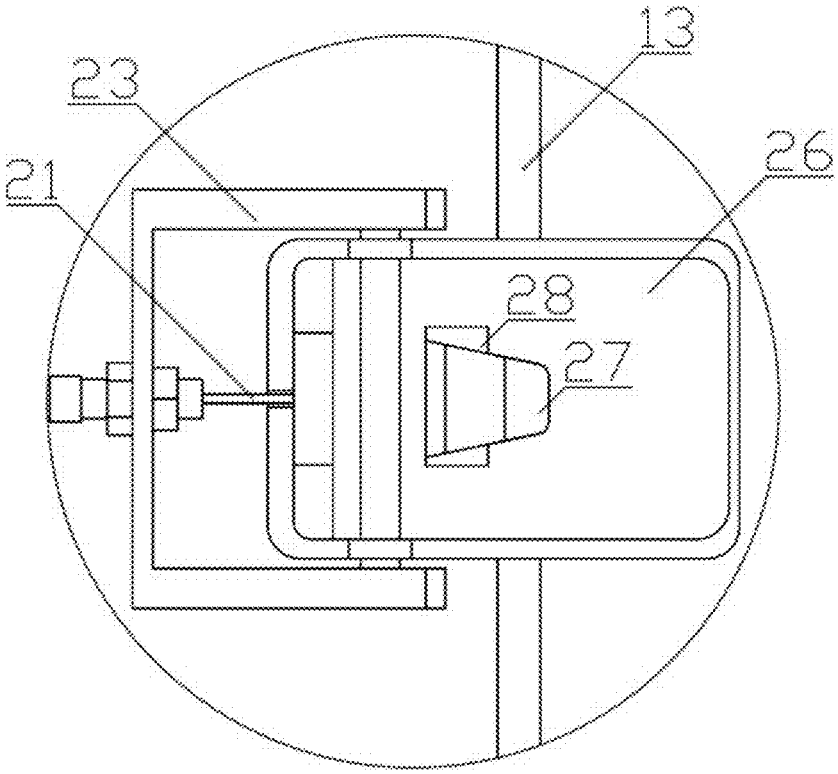
FIG. 13 is an enlarged view of area VII in FIG. 3 and FIG. 6.
Figure 14:
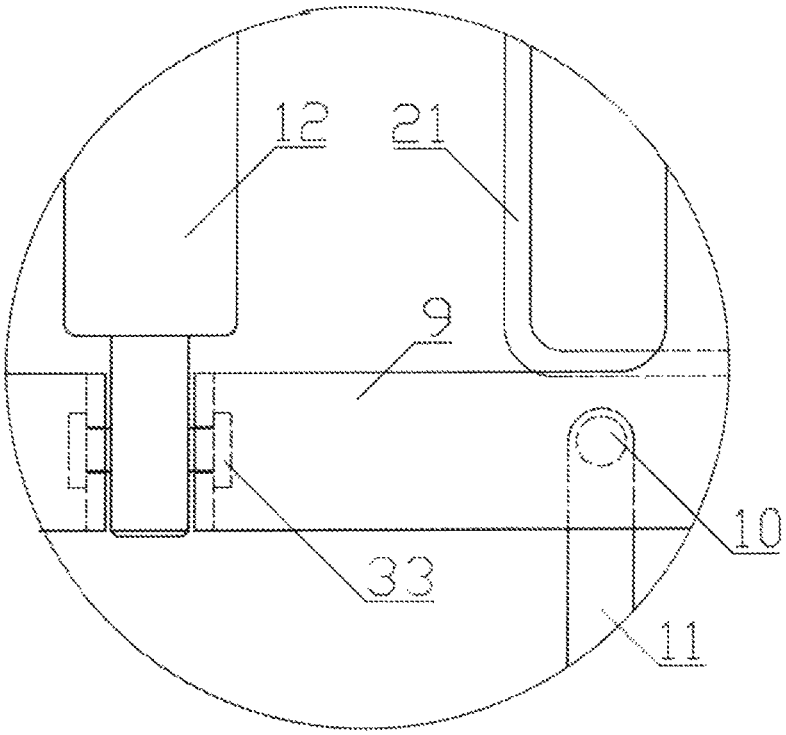
FIG. 14 is an enlarged view of area VIII in FIG. 3 and FIG. 6.
Figure 15:
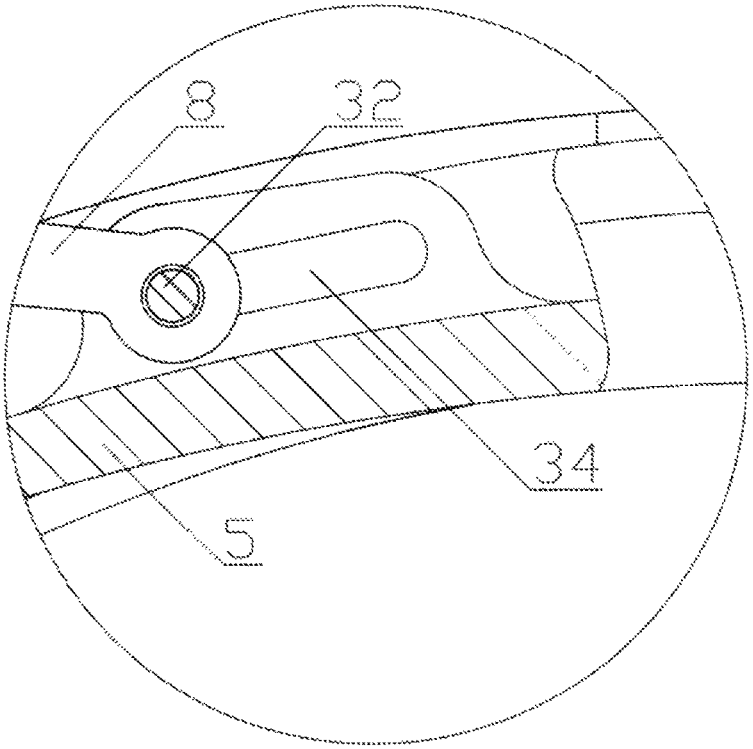
FIG. 15 is an enlarged view of area IX in FIG. 6.

In FIG. 8, the state of the pawl 25 and ratchet handle 26 is a static state of the backrest 5; when the backrest 5 needs to be moved in contact with the back of the human body, the ratchet handle 26 is moved upward along the rotating shaft 22, the through hole 28 drives the pawl handle 27 to move backwards, so that the pawl 25 is moved from the front engagement of the ratchet 24 to the rear engagement of the ratchet 24; the cable 21 is pulled simultaneously; the pull rod 30 is pulled by the cable 21 to open the valve 29; the compression spring in the gas rod 12 is extended to stretch the gas rod 12, and the connecting arm I 9 is driven by the connecting pin 33 to move forward along the elongated groove 11; at the same time, the casing 6 and rocker arm 8 are driven by the oscillating pin 17 and oscillating groove 18 to rotate around the spindle 16 in inward and forward mode; meanwhile, the backrest 5 is driven by the rocker arm 8 through the pivot pin 32 to move forward, to closely fit with the back of the human body. When the human body leans backwards, the back of the human body will backward push the backrest 5; the rocker arm 8 and casing 6 are driven by the backrest 5 through the pivot pin 32 to rotate around the spindle 16 in outward and backward mode; at the same time, the connecting arm I 9 is driven by the rocker arm 8 through the oscillating groove 18 and oscillating pin 17 to move backward along the elongated groove 11; meanwhile, the compression spring in the gas rod 12 is compressed by the connecting arm I 9 through the connecting pin 33, so that the gas rod 12 is shortened. During use, if the backrest 5 needs to stay at a certain position throughout the movement stroke, it should be pulled upward, and then the pawl handle 27 is laid down, so that the pawl 25 is moved from the rear engagement of the ratchet 24 to the front engagement of the ratchet 24; then the ratchet handle 26 is laid down along the rotating shaft 22, so as to loosen the cable 21 and pull rod 30 until the valve 29 is closed. Of course, for the chair with a backrest that may closely fit with the back of the human body to move in the disclosure, the gas rod 12 can be realized by using compression spring, extension spring, elastic rubber and so on. The schemes that the connecting arm I 9 is driven by an elastic structure through the connecting pin 33 to move along the elongated groove 11; at the same time, the casing 6 and rocker arm 8 are driven by the oscillating pin 17 and oscillating groove 18 to rotate around the spindle 16; meanwhile, the backrest 5 is driven by the rocker arm 8 through the pivot pin 32 to move shall fall within the protection scope of the disclosure.

The differences between Embodiment 3, Embodiment 4, Embodiment 5, Embodiment 6 and Embodiment 1 lie in the specific structure of the transmission part 40.

Figure 16:
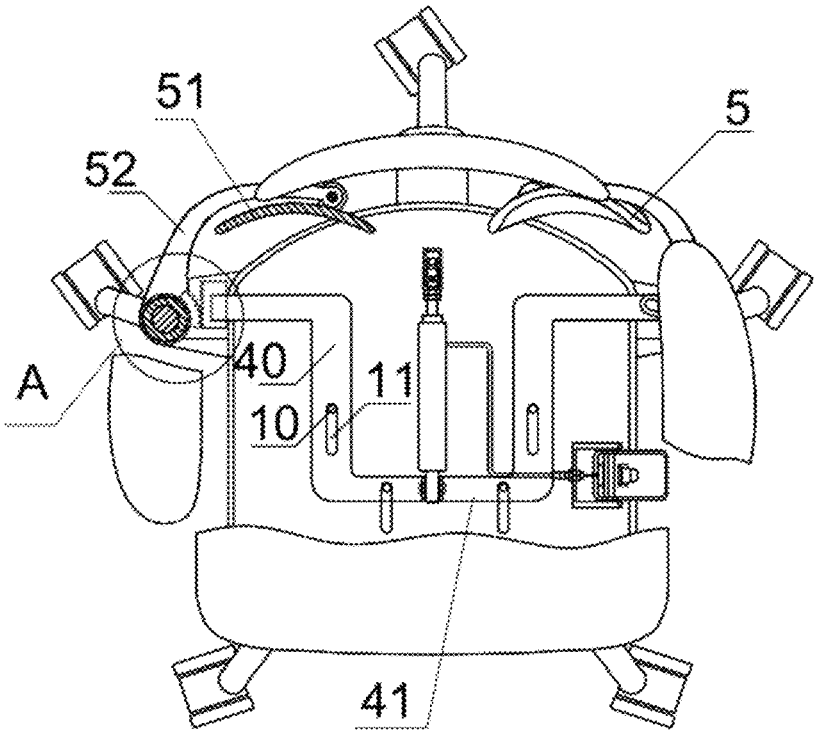
FIG. 16 is a top view of Embodiment III.
Figure 17:
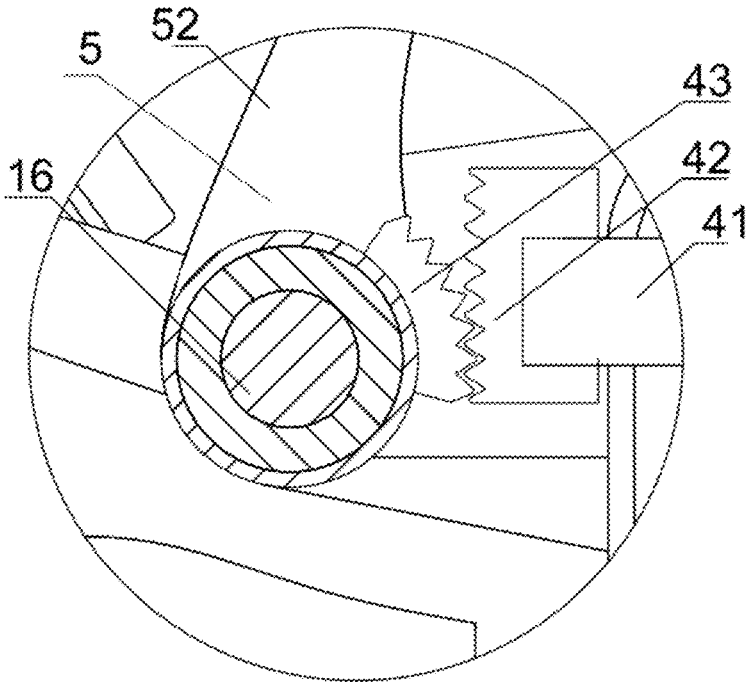
FIG. 17 is an enlarged detail view of area A in FIG. 16.

Specifically, Embodiment 3 is as shown in FIG. 16 and FIG. 17; the gas spring 12 can be directly installed below the seat cushion 3 or indirectly assembled below the seat cushion 3 through such connecting parts as bottom plate. The installation mode is not limited in the technical solution. The transmission realized through the gear and rack is an embodiment of the transmission part 40. Specifically, the gas spring 12 is extended to drive the connecting arm 41 to move forward; the end of the connecting arm 41 is connected to the connecting rack 42, to drive the connecting rack 42 to move forward; the oscillating gear 43 driven by the forward-moving connecting rack 42 is naturally rotated, to drive the lumbar support 5 to swing. The slotted direction of the elongated groove 11 is also the forward-backward direction; the pin 10 can be directly connected to the seat cushion 3 at a fixture such as bottom plate; the coordination between the pin 10 and the elongated groove 11 may increase the forward orientation and stability when the connecting arm 41 is pushed by the gas spring 12.

In addition, the lumbar support 5 includes a swing arm 52, a supporting plate 51 movably connected with the swing arm 52, and a torsion spring for adjusting the preset angle of the supporting plate 51.

The swing arm 52 can be directly connected or indirectly connected with the transmission part 40 (i.e., oscillating gear 43); the swing arm 52 is involved in swinging; a supporting plate 51 is connected to the swing arm 52; the supporting plate 51 is movably connected with the swing arm 52, that is, the supporting plate 51 may adjust the angle relative to the swing arm 52, so that the supporting plate 51 may flexibly and comfortably fit with the back of the human body.

A torsion spring is arranged at the junction of the supporting plate 51 and the swing arm 52. The torsion spring has two functions: First, when the human body leans forward or backward, the torsion spring may provide a suitable torsion for the supporting plate 51, so that the angle adjustment of the supporting plate 51 is more flexible; secondly, when the human body leaves the seat, the torsion spring may automatically adjust the angle of the supporting plate 51 to a preset angle (for example, facing the front and non-tilting), so as to improve appearance and uniformity.

The lumbar support 5 is provided with a functional block. The functional block is a magnetic block, an electric heating block or a massage block. The functional block is detachably installed on the lumbar support 5. Since the emphasis of the technical solution is that the lumbar support 5 may closely fit with the back of the human body, in addition to the supporting comfortability, the technical solution also includes the fitting degree of the healthy magnetic therapy. Manufacturers can add different functional blocks according to actual business needs, such as magnetic therapy, electric heating and massage, and can also produce multiple functional blocks by using a unified connection installation method, so that users can choose to replace and install the blocks.

The lumbar support seat further includes a changeover switch assembly for switching the adjustment state and locking state of the gas spring 12. The change-over switch assembly is used for switching the state of the gas spring 12. When the gas spring 12 is in the adjustment state, the gas rod of the gas spring 12 can be freely extended and retracted. In this state, when the human body leans backward, the gas rod is retracted and lumbar support 5 swings backward; when the human body leans forward, the gas rod is extended and lumbar support 5 swings forward. When the gas spring 12 is in the locking state, the extension length of the gas rod is locked, and the lumbar support 5 is also fixed and does not swing back and forth.

Embodiment 4

Figure 18:
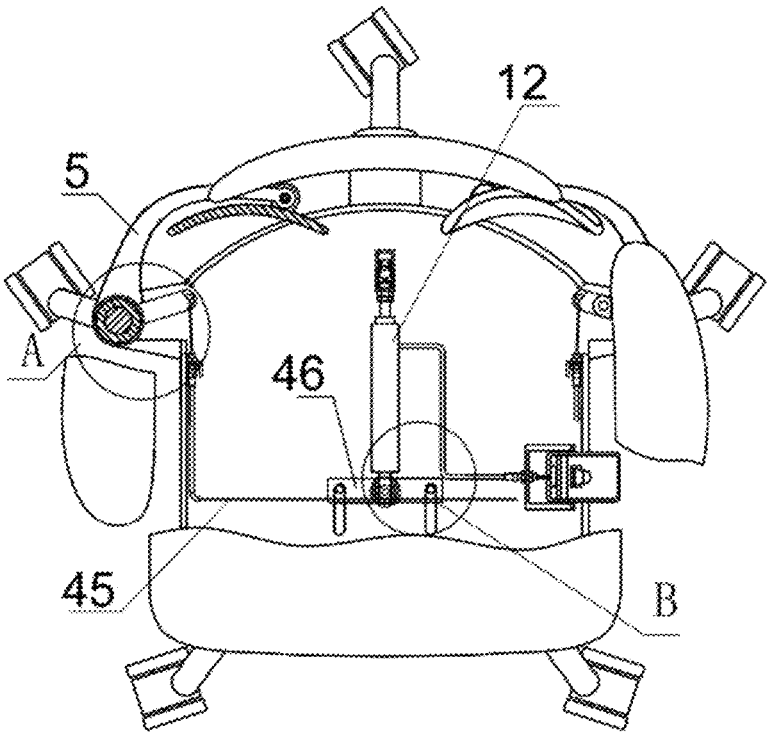
FIG. 18 is a top view of Embodiment IV.
Figure 19:
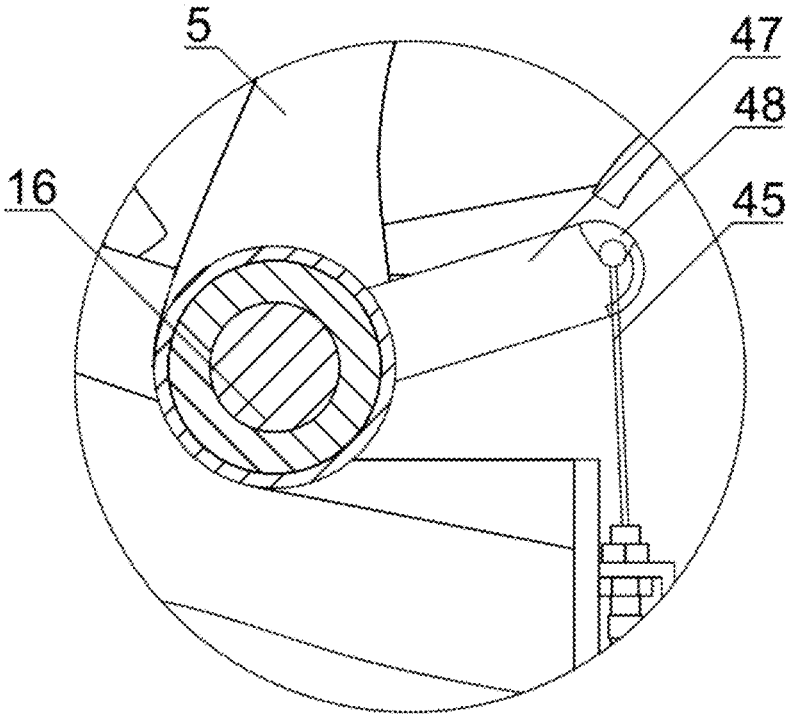
FIG. 19 is an enlarged detail view of area A in FIG. 18.
Figure 20:
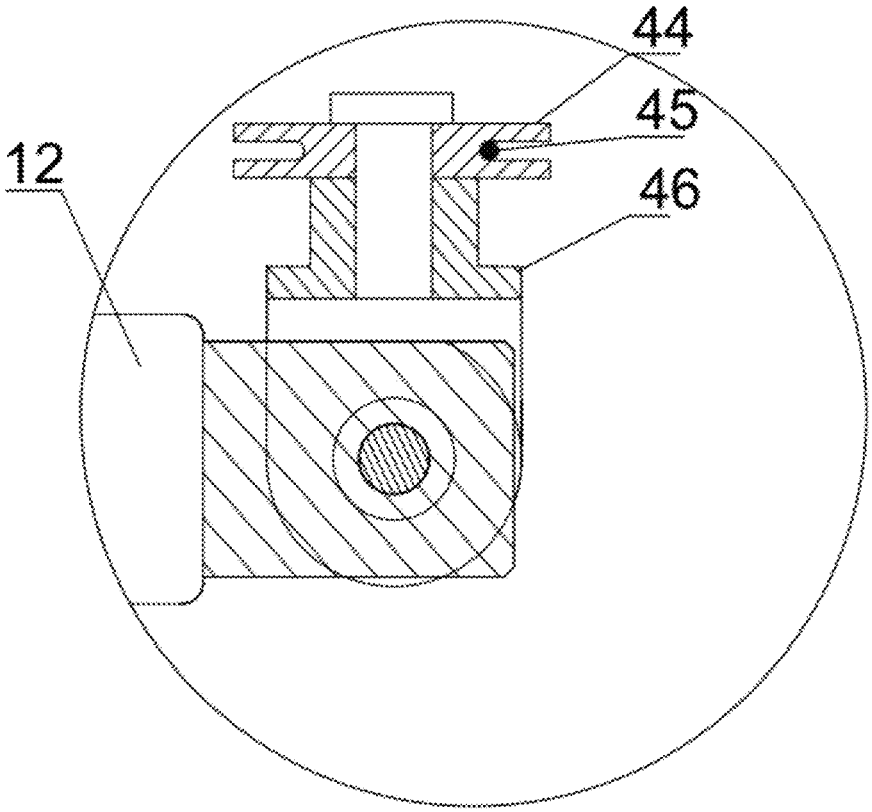
FIG. 20 is a side sectional view of area B in FIG. 18.

As shown in FIG. 18, FIG. 19 and FIG. 20, the difference between Embodiment 4 and Embodiment 3 also lies in the specific structure of the transmission part 40. In Embodiment 4, the transmission part 40 includes a connecting piece 46 connected with the gas spring 12, a roller 44 connected to the connecting piece 46, a drawn wire 45 located in a wheel groove of the roller 44, and a rotating arm 47 connected with the rotating shaft assembly; the drawn wire 45 is connected with the rotating arm 47. The rotating arm 47 is provided with a wiredrawing head bayonet 48; the drawn wire 45 is connected with the wiredrawing head bayonet 48.

The coordination between the drawn wire 45 and the roller 44 is another specific embodiment of the transmission part 40. Specifically, the forward-moving gas spring 12 drives the connecting piece 46 to move forward; the connecting piece 46 may be connected with the roller 44 through fixtures such as a pin. A roller 44 is connected to the connecting piece 46; a drawn wire 45 is installed on the roller 44, to form a forward-stretching motion of the drawn wire 45; the drawn wire 45 pulls the rotating arm 47 to rotate.

Embodiment 5

Figure 21:
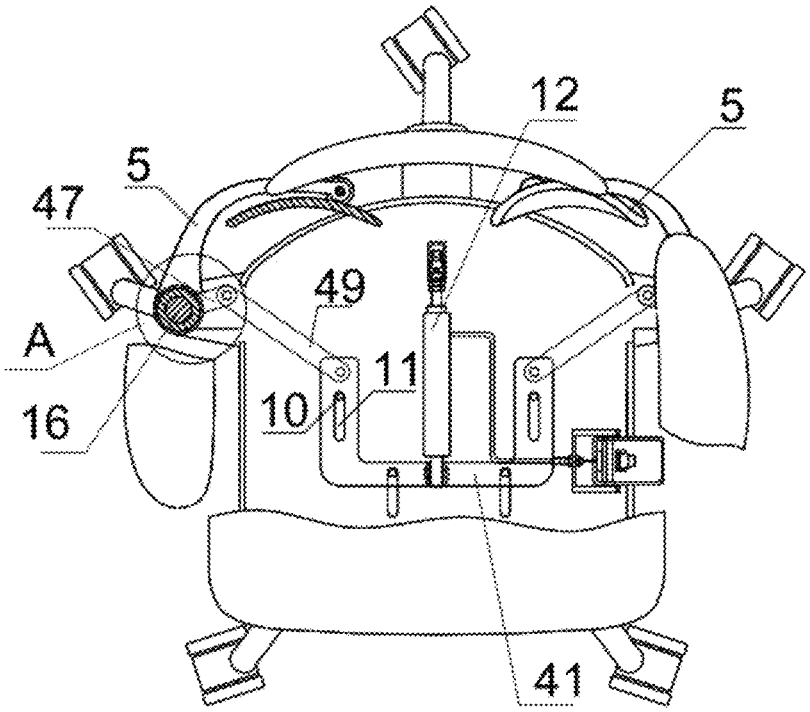
FIG. 21 is a top view of Embodiment V.
Figure 22:
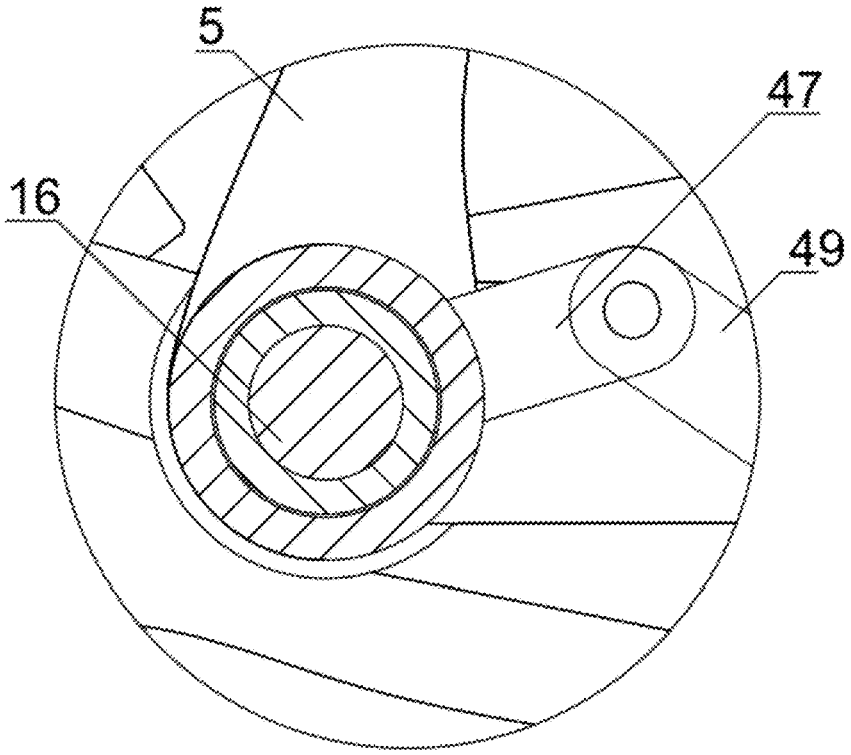
FIG. 22 is an enlarged detail view of area A in FIG. 21.

As shown in FIG. 21 and FIG. 22, the difference between Embodiment 5 and Embodiment 3 also lies in the specific structure of the transmission part 40. In Embodiment 5, the transmission part 40 includes a connecting arm 41 connected with the gas spring 12, a rotating arm 47 connected with the rotating shaft assembly and a connecting rod 49; both ends of the connecting rod 49 are hinged with the connecting arm 41 and the rotary arm 47, respectively. The gas spring 12 is installed below the seat cushion 3; the connecting arm 41 is slidably connected below the seat cushion 3; an elongated groove 11 is arranged on the connecting arm 41; the extending direction of the elongated groove 11 is parallel to the telescopic direction of the gas spring 12; the lumbar support seat further includes a pin 10 connected with the seat cushion 3 and movably embedded in the elongated groove 11.

The method of using the rotating arm 47 and the connecting rod 49 is another specific embodiment of the transmission part 40. Specifically, the gas spring 12 is extended to drive the connecting arm 41 to move forward; the connecting arm 41 is hinged with a connecting rod 49; the other end of the connecting rod 49 is hinged with a rotating arm 47. When the connecting arm 41 moves forward, the rotating arm 47 is driven to rotate by the connecting rod 49; the rotating arm 47 rotates about the spindle 16.

Embodiment 6

Figure 23:
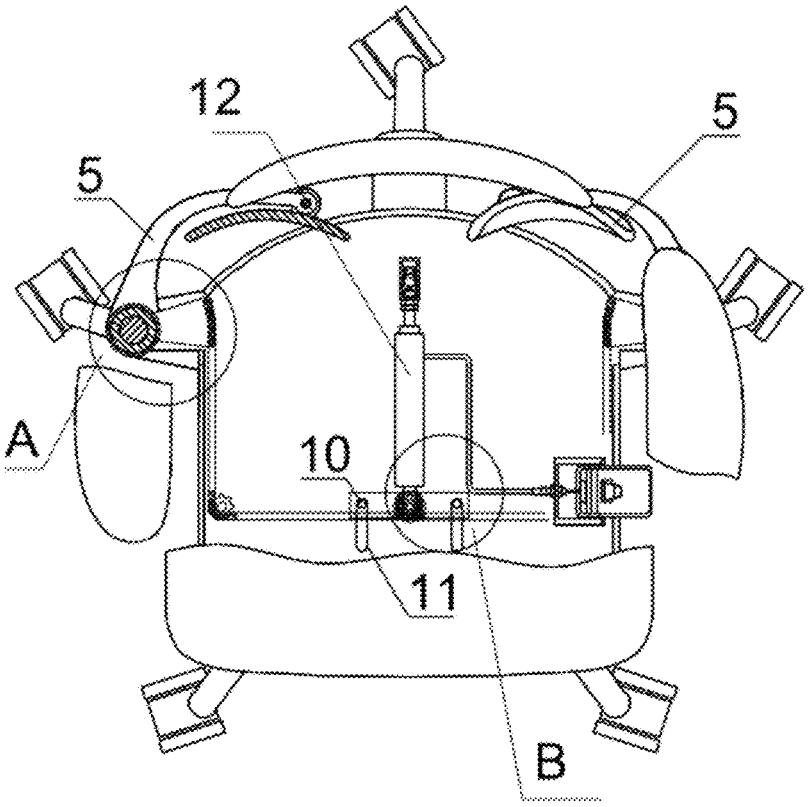
FIG. 23 is a top view of Embodiment VI.
Figure 24:
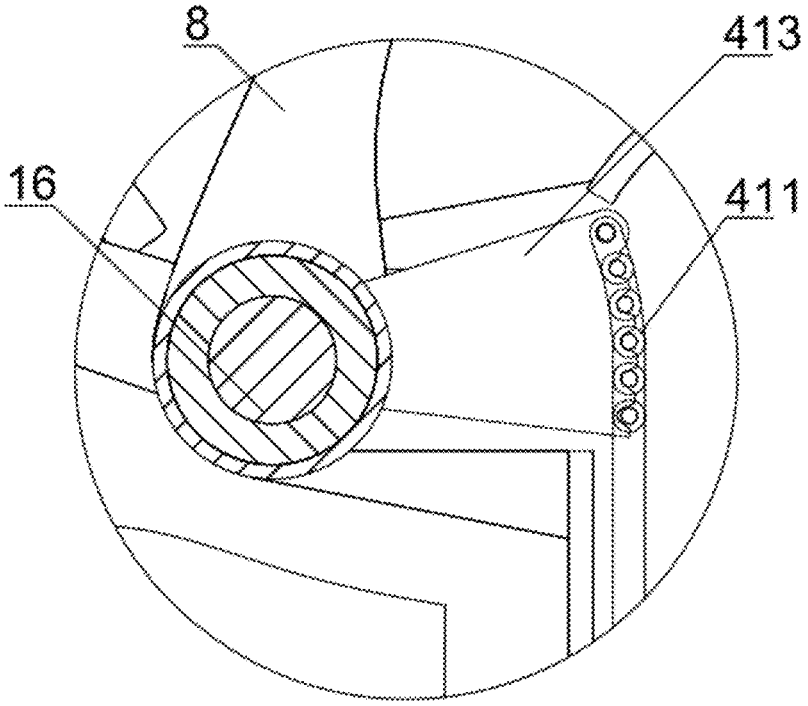
FIG. 24 is an enlarged detail view of area A in FIG. 23.
Figure 25:
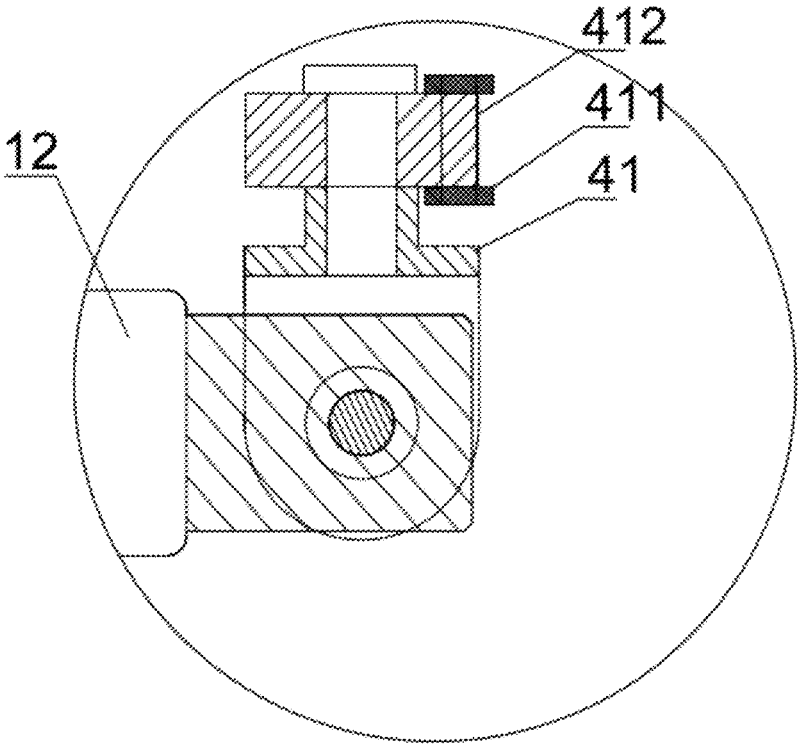
FIG. 25 is a side sectional view of area B in FIG. 23.

As shown in FIG. 23, FIG. 24 and FIG. 25, the difference between Embodiment 6 and Embodiment 3 also lies in the specific structure of the transmission part 40. In Embodiment 6, the transmission part 40 includes a connecting arm 41 connected with the gas spring 12, a sprocket 412 connected to the connecting arm 41, a sprocket connector 413 connected with the rotating shaft assembly and a chain 411; the chain 411 is in meshing connection with the sprocket 412; the chain 411 is in meshing connection with the sprocket connector 413.

The method of using the gear and chain is another specific embodiment of the transmission part 40. Specifically, a connecting arm 41 is connected to the gas spring 12; a sprocket 412 is connected to the connecting arm 41; the chain 411 is in meshing connection with the sprocket 412. When the gas spring 12 is extended, the chain 411 is pulled forward; the other end of the chain 411 is meshed with the sprocket connector 413, to drive the sprocket connector 413 to swing around the spindle 16. In this manner, the technical solution that the chain 411 is matched with the sprocket 412 can also be replaced by a common cooperation scheme of the synchronous belt and synchronous pulley, and the principle is the same.

INDUSTRIAL APPLICABILITY

According to the disclosure, the lumbar support, gas spring, transmission part and other parts of the seat can be connected to form a lumbar support seat product, which can be put into mass production by matching the assembly line.

What is claimed is:

1. A seat with a lumbar support, comprising at least one lumbar support and a gas spring; the lumbar support configured to fit against a back of a human body through expansion of the gas spring when the back is moved relative to the seat, to provide a continuous and uniform support force; wherein the lumbar support comprises two lumbar supports, each configured to rotate in a horizontal direction; wherein the seat comprises a rotating shaft assembly and a transmission part associated with each lumbar support, the rotating shaft assembly comprises a spindle, and the associated lumbar support rotates about the spindle as an axis; wherein the rotation of the lumbar support is realized by expansion of the gas spring being transmitted through the transmission part; and wherein the extending direction of the gas spring is a horizontal front and back direction.

2. The seat with a lumbar support according to claim 1, wherein one end of the gas spring is connected with the transmission part; the transmission part is connected with the spindle; the spindle is connected with the lumbar support and drives the lumbar support to rotate.

3. The seat with a lumbar support according to claim 1, wherein one end of the gas spring is connected with the transmission part; the transmission part is connected with a rotating connector; the rotating connector is sleeved on the spindle; the rotating connector is connected with the lumbar support and drives the lumbar support to rotate.

4. The seat with a lumbar support according to claim 1, wherein the transmission part comprises a connecting arm connected to one end of the gas spring, a connecting rack connected to the connecting arm, and an oscillating gear connected with the rotating shaft assembly and meshed with the connecting rack.

5. The seat with a lumbar support according to claim 4, wherein the gas spring is installed below a seat cushion; the connecting arm is slidably connected below the seat cushion; an elongated groove is arranged on the connecting arm; the extending direction of the elongated groove is parallel to the telescopic direction of the gas spring; the lumbar support seat further comprises a pin connected with the seat cushion and movably embedded in the elongated groove.

6. The seat with a lumbar support according to claim 1, wherein the transmission part comprises a connecting piece connected with the gas spring, a roller connected to the connecting piece, a wire located in a wheel groove of the roller, and a rotating arm connected with the rotating shaft assembly; the wire is connected with the rotating arm.

7. The seat with a lumbar support according to claim 6, wherein the rotating arm is provided with a wire head bayonet; the wire is connected with the wire head bayonet.

8. The seat with a lumbar support according to claim 7, wherein the transmission part comprises a connecting arm connected with the gas spring, a rotating arm connected with the rotating shaft assembly and a connecting rod; both ends of the connecting rod are hinged with the connecting arm and the rotary arm, respectively.

9. The seat with a lumbar support according to claim 7, wherein the gas spring is installed below a seat cushion; the connecting arm is slidably connected below the seat cushion; an elongated groove is arranged on the connecting arm; the extending direction of the elongated groove is parallel to the telescopic direction of the gas spring; the lumbar support seat further comprises a pin connected with the seat cushion and movably embedded in the elongated groove.

10. The seat with a lumbar support according to claim 1, wherein the transmission part comprises a connecting arm connected with the gas spring, a sprocket connected to the connecting arm, a sprocket connector connected with the rotating shaft assembly and a chain; the chain is in meshing connection with the sprocket; the chain is in meshing connection with the sprocket connector.

11. The seat with a lumbar support according to claim 1, wherein the transmission part comprises a connecting arm connected with the gas spring, an oscillating pin arranged on the connecting arm, and a sleeve member sleeved on the spindle; the sleeve member is provided with an oscillating groove within which the oscillating pin slides.

12. The seat with a lumbar support according to claim 1, wherein the lumbar support comprises a swing arm, a supporting plate movably connected to the swing arm, and an angle adjustment unit for adjusting the preset angle of the supporting plate.

13. The seat with a lumbar support according to claim 12, wherein the angle adjustment unit is torsion spring.

14. The seat with a lumbar support according to claim 1, wherein the lumbar support is provided with a functional block.

15. The seat with a lumbar support according to claim 14, wherein the functional block is a magnetic block, an electric heating block or a massage block.

16. The seat with a lumbar support according to claim 1, further comprising a change-over switch assembly for switching an adjustment state and a locking state of the gas spring.

17. The seat with a lumbar support according to claim 16, wherein the gas spring is provided with a valve; the change-over switch assembly comprises an operating member, a cable connected with the operating member, and a pull rod connected with the cable; the pull rod is connected against the valve and is pulled away from the valve by the cable.

18. The seat with a lumbar support according to claim 1, wherein there are two rotating shaft assemblies which are located on both sides of a seat cushion; there are two lumbar supports which are individually connected to the rotating shaft assemblies, respectively.

19. The seat with a lumbar support according to claim 1, wherein there is one rotating shaft assembly which is located on one side of a seat cushion; there is one lumbar support which is connected to the rotating shaft assembly.

* * * * *